US009797091B2

(12) United States Patent
Loo et al.

(10) Patent No.: US 9,797,091 B2
(45) Date of Patent: Oct. 24, 2017

(54) FELT CONDITIONER AND CLEANER

(71) Applicant: Buckman Laboratories International, Inc., Memphis, TN (US)

(72) Inventors: Kooi Hock Loo, Singapore (SG); Lili Liu, Singapore (SG)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 14/950,193

(22) Filed: Nov. 24, 2015

(65) Prior Publication Data

US 2016/0145800 A1 May 26, 2016

Related U.S. Application Data

(60) Provisional application No. 62/084,192, filed on Nov. 25, 2014.

(51) Int. Cl.

| | |
|---|---|
| ***D21F 1/30*** | (2006.01) |
| ***C11D 3/20*** | (2006.01) |
| ***D21F 1/32*** | (2006.01) |

(52) U.S. Cl.

CPC ..... *D21F 1/30* (2013.01); *C11D 3/2072* (2013.01)

(58) Field of Classification Search

CPC ..... D21H 21/02; D21H 21/24; D21H 23/50; D21F 1/30; D21F 1/32; D21F 7/12; Y10S 162/04; Y10S 162/03; C11D 7/50; C11D 3/2702; C11D 3/2072

See application file for complete search history.

(56) References Cited

U.S. PATENT DOCUMENTS

| | | | | |
|---|---|---|---|---|
| 4,715,931 | A | 12/1987 | Schellhamer et al. | |
| 4,861,429 | A | 8/1989 | Barnett et al. | |
| 4,895,622 | A | 1/1990 | Barnett et al. | |
| 4,995,994 | A | 2/1991 | Singer | |
| 5,167,767 | A | 12/1992 | Owiti et al. | |
| 5,368,694 | A | 11/1994 | Rohlf et al. | |
| 5,520,781 | A | 5/1996 | Curham et al. | |
| 5,575,893 | A | 11/1996 | Khan et al. | |
| 5,651,973 | A | 7/1997 | Moo-Young et al. | |
| 5,863,385 | A | 1/1999 | Siebott et al. | |
| 6,051,108 | A | 4/2000 | O'Neal, Jr. | |
| 6,171,445 | B1 | 1/2001 | Hendriks et al. | |
| 7,306,702 | B2 | 12/2007 | Pease et al. | |
| 2014/0031271 | A1 | 1/2014 | Lourenco | |
| 2016/0145800 | A1* | 5/2016 | Loo | C11D 7/50 162/199 |

FOREIGN PATENT DOCUMENTS

| | | | | |
|---|---|---|---|---|
| CN | 103468434 | A | 12/2013 | |
| EP | 0550230 | B1 | 7/1993 | |
| KR | 20130021731 | A | 3/2013 | |
| KR | 101499611 | A | 3/2015 | |
| WO | 9529292 | | 11/1995 | |
| WO | WO 2016085912 | A1 * | 6/2016 | C11D 7/50 |

OTHER PUBLICATIONS

Machine Translation of CN 103468434 A, published on Dec. 2013.*
Machine Translation of KR 20130021731 a, published on Mar. 2013.*
International Search Report and Written Opinion issued in corresponding International Patent Application No. PCT/US2015/62290, dated Feb. 26, 2016 (11 pages).

* cited by examiner

*Primary Examiner* — Jose Fortuna
(74) *Attorney, Agent, or Firm* — Kilyk & Bowersox, P.L.L.C.

(57) ABSTRACT

A method of cleaning or conditioning a paper-making press felt or other substrate is described. The method includes treating the paper-making press felt or other substrate with a formulation that contains at least solketal.

24 Claims, No Drawings

FELT CONDITIONER AND CLEANER

This application claims the benefit under 35 U.S.C. §119 (e) of prior U.S. Provisional Patent Application No. 62/084,192, filed Nov. 25, 2014, which is incorporated in its entirety by reference herein.

BACKGROUND OF THE INVENTION

The present invention relates to felt conditioners and felt cleaners. For example, the present invention relates to methods to treat a paper-making press felt that uses a felt conditioner or cleaner. Thus, the present invention provides a method of cleaning or conditioning a paper-making press felt used in a paper-making process.

Chemical cleaning of press felts used in a paper mill provide or maintain design characteristics of the felt and extend its operational life. Generally, chemical cleaning or conditioners fall into three (3) main groups: acid-based, alkaline-based, or organic-based. When organic-based felt conditioners are used, though highly favored, the solvent can have poor water solubility which can cause nozzle blockage and/or the solvent can have a strong smell with a high evaporation rate, which can be undesirable, and even viewed by some as a hazard to the environment.

Accordingly, there is a need in the industry to provide a new solvent-based system that preferably has a low evaporation rate, that is essentially odorless, and is environmentally friendly. Further, a new solvent system that provides one or more of these characteristics should also provide comparable felt cleaning and conditioning properties and preferably be water soluble or at least have satisfactory water solubility.

SUMMARY OF THE PRESENT INVENTION

A feature of the present invention is to provide a felt conditioner or cleaner having a lower evaporation rate, for instance, compared to current commercially available felt conditioners that are solvent-based.

Another feature of the present invention is to provide a felt conditioner or cleaner that has suitable water solubility.

A further feature of the present invention is to provide a felt conditioner or cleaner that is odorless or essentially odorless.

A further feature of the present invention is to provide a felt conditioner or cleaner that is environmentally friendly or considered "green" chemistry based.

An additional feature of the present invention is to provide a felt conditioner or cleaner that provides improved cleaning and/or water penetration effects.

An additional feature of the present invention is to provide a felt conditioner or cleaner that is solvent-based, but not aromatic and/or has low toxicity.

An additional feature of the present invention is to provide a felt conditioner or cleaner that has excellent stability for storage and easy transportation.

A further feature of the present invention is to provide a felt conditioner or cleaner that is solvent-based, with a high flash point.

To achieve these and other advantages, and in accordance with the purposes of the present invention, as embodied and broadly described herein, the present invention relates to a felt conditioner or felt cleaner. The felt conditioner or cleaner includes at least solketal. The felt conditioner or cleaner can contain solketal alone or with other felt conditioning and/or cleaning chemicals or ingredients.

The present invention further relates to a method to treat a papermaking press felt that uses the felt conditioner or felt cleaning composition of the present invention.

Additional features and advantages of the present invention will be set forth in part in the description that follows, and in part will be apparent from the description, or may be learned by practice of the present invention. The objectives and other advantages of the present invention will be realized and attained by means of the elements and combinations particularly pointed out in the description and appended claims.

It is to be understood that both the foregoing general description and the following detailed description are exemplary and explanatory only and are intended to provide a further explanation of the present invention, as claimed.

DETAILED DESCRIPTION OF THE PRESENT INVENTION

The present invention relates to felt conditioners and/or felt cleaners that are present as a composition or formulation. The felt conditioner or felt cleaner contains at least solketal and can contain other felt conditioning and/or cleaning chemicals or components, for instance, as further described below. The felt conditioner can be used to clean and/or condition any device (machine or feeder, or belt or felt or fabric or screen) used in a paper mill and/or pulp mill. The felt conditioner or cleaner is useful in treating a papermaking press felt. The felt conditioner or cleaner can be used in a method to clean a papermaking press felt or condition a papermaking press felt or both. The felt conditioner can be used in boil out operations as that term is used in papermaking. The felt conditioner can be used to clean one or more papermaking or pulp making machines or a surface thereof and/or piping and/or screen(s) or other components used or present in a papermaking or pulp making process.

In more detail, for purposes of the present application, the term "felt conditioner" is used throughout, but it is to be understood that the "felt conditioner" is considered a felt conditioner and/or felt cleaner. In other words, the felt conditioner composition of the present invention can be used and is capable of conditioning a papermaking press felt and/or is capable of cleaning a papermaking press felt and can be used for other cleaning/conditioning as mentioned.

The felt conditioner of the present invention comprises, consists essentially of, consists of, or includes solketal alone or with other felt conditioning and/or cleaning chemicals.

Solketal is also known as di-isopropylidene glycerol or 2,2-dimethyl-4-hydroxymethyl-1,3-dioxolane or 1,2-isopropylidene-glycerol or 2,2-dimethyl-1,3-dioxolane-4-methanol, and the like. Solketal is also known as glycerolacetone or dioxolan. Solketal is commercially available, for instance, from Sigma-Aldrich or Rhodia. Solketal generally has a flash point of 80° C. and a boiling point of from about 188° to 190° C.

Solketal is highly advantageous, based on the studies in the present invention, with regard to being the primary component in a felt conditioner. Solketal is colorless and is a clear liquid, and is considered non-corrosive with a low evaporation rate and has little to no odor and is considered low in toxicity. Further, from studies in the present invention, it has been determined that the solketal has excellent solvency properties for wet- and/or dry-strength additives, lignin, starch, sizes, fatty acids, glue, latex, oil, grease, and/or waxes that are or can be found on felts used in the papermaking industry. Also, the solketal is miscible in common organic solvents and/or water, which helps to optimize the use of it. The solketal used in the present invention can be used alone or with other solvents and/or with surfactants, which are described in more detail below.

The felt conditioner formulation of the present invention can contain the solketal in an amount of from 0.5 wt % to 100 wt %, such as from about 1 wt % to 100 wt %, from about 5 wt % to 95 wt %, from about 10 wt % to about 90 wt %, from about 15 wt % to about 90 wt %, from about 20 wt % to about 90 wt %, from about 30 wt % to about 90 wt %, from about 40 wt % to 95 wt %, from about 70 wt % to 99 wt %, based on the overall weight of the felt conditioner formulation.

The felt conditioner can contain one or more surfactants, such as one or more non-ionic surfactants, one or more anionic surfactants, and/or one or more cationic surfactants. Examples are provided below.

The felt conditioner can be aromatic-free.

The felt conditioner of the present invention can contain water, and/or one or more other diluents, and/or one or more additional cleaning agents and/or one or more additional conditioning agents.

The amount of water, if present or other diluents, can be from about 0.5 wt % to about 99.5 wt % based on the overall weight of the felt conditioner formulation. The amount of the surfactant(s), if present, can be an amount of from about 0.5 wt % to about 99.5 wt % based on the overall weight of the felt conditioner formulation. The amount of other cleaning agents and/or other conditioning agents that can optionally be present in the felt conditioner formulation of the present invention can be from about 10 wt % to about 90 wt % based on the overall weight of the felt conditioner formulation. For any of these ranges, other amounts can include from about 1 wt % to about 95 wt %, from about 5 wt % to about 90 wt %, from about 10 wt % to about 75 wt %, from about 20 wt % to about 70 wt %, from about 40 wt % to about 60 wt %, based on the overall weight of the felt conditioner formulation.

The concentration of active ingredient or the concentration of felt conditioner formulation that is applied onto the felt, after optional dilution, can be an amount of from about 100 ppm to about 3 wt % such as from about 100 ppm to about 1 wt %, from about 100 ppm to about 0.75 wt %, from about 100 ppm to about 0.5 wt % based on the overall amount of liquid being used to treat the press felt.

Paper can be produced in a continuous manner from a fibrous suspension (pulp furnish) that can be made of water and cellulose fibers. A paper-making process can involve three stages: forming, pressing, and drying. In the forming stage, dilute pulp furnish is directed on a wire or between two wires. The majority of the water is drained from the pulp furnish, through the wire, creating a wet paper web. In the pressing stage, the paper web comes in contact with one or generally more porous press felts that are used to extract much of the remaining water from the web. Often the pickup felt is the first felt that the wet paper web contacts which is used to remove the paper web from the wire, via a suction pickup roll positioned behind the felt, and then to transport the paper web to the rest of the press section. The paper web then generally passes through one or more presses that can have rotating press rolls and/or stationary elements such as press shoes that are positioned in close proximity to each other forming a press nip. In each nip, the paper web comes in contact with either one or two press felts where water is forced from the paper web and into the press felt via pressure and/or vacuum. In single-felted press nips, the paper web is in contact with the press roll on one side and the felt on the other. In double-felted press nips, the paper web passes between the two felts. After the press section, the paper web is dried to remove the remaining water, usually by weaving through a series of steam heated dryer cans.

Press felts can be made of nylon base fabric, which can be made of from 1 to 4 individual layers of filaments arranged in a weave pattern. An extruded polymeric membrane or mesh can also be included as one or more of the base fabric layers. Batt fibers, of smaller diameter than the base fabric filaments, are needled into the base on both sides giving the felt a thick, blanket-like appearance. Press felts are designed to quickly take in water from the paper web in the nip and hold the water so that it does not re-absorb back into the sheet as the paper and felt exit the press nip. Press felts can be an endless loop that circulates continuously in a belt-like fashion between sheet contact stages and return stages. Water pulled into the felt from the paper web at the nip is generally removed from the felt by vacuum during the felt return stage at, what is frequently referred to as, the uhle box.

A variety of materials can be dissolved or suspended in the liquid contained in the paper web when it reaches the press felt and these materials can therefore be transferred into the press felt along with the water extracted from the paper web. One or more of these materials can remain with the press felt and accumulate there instead of being removed with the water at the uhle box. The dissolved or suspended materials that can be present in or on the press felt include material from the fibrous pulp such as cellulose fines, hemicelluloses, and sticky components such as wood pitch from fresh wood pulps and glues, resins, and waxes from recycled pulps. Byproducts of microbiological growth such as polysaccharides, proteins, and other biological matter, can also be present in the stock and therefore in the press felts. Various functional additives that are added to paper stock to impart certain properties to the finished paper can also find their way to the press felts. These additives include sizes such as rosin, alkyl ketene dimer (AKD), and alkenyl succinic anhydride (ASA); wet strength resins and dry strength agents for example starch; and inorganic fillers including clay, talc, precipitated or ground calcium carbonate (PCC, GCC), and titanium dioxide. Processing additives used in paper production can also be present in press felts, and include retention and drainage aids including alum, organic polymers, and various micro-particles; and defoamers, in particular those based on oil.

For efficient paper production, the press felts should be deposit-free. Deposits that form on press felts such as oily or sticky materials can transfer back to the web resulting in dirt spots or holes in the finished paper. They can also cause paper breaks or tears leading to lost production. Further, the press felts should be porous with high void volume. It is expensive and energy intensive to evaporate water from paper in the dryer section, making it helpful that the press felts remove as much water as possible from the paper web in the press section. Felts that become filled with contaminants that limit water movement through the felt will thus limit the amount of water that can be removed from the web. This can force the machine speed to be slowed in order to allow time for the web to dry in the dryer section. Felts that are unevenly filled can also lead to uneven water removal from the sheet which can result in moisture streaks, wrinkles, and web breaks.

Some hydrophobic materials such as waxes can form a barrier layer at the felt surface preventing water from entering the felt. Other hydrophobic materials, that are tacky or sticky, such as pitch and defoamer oils can increase felt compaction, causing a loss in void volume, thus limiting the amount of water that can enter the press felt. Deposits containing particulate materials on or embedded within the press felt structure can result in wear problems limiting the life of the press felt. Some hydrophilic materials such as, starches, proteins, and hemicelluloses tend to exist within the felt in the form of gels that can actually trap water, as well as other depositing materials, within the felt thus limiting the amount of water that can be removed at the uhle box. These hydrophilic gels are particularly problematic in felts since currently used felt conditioning treatments are ineffective at inhibiting them.

The felt conditioners of the present invention have the ability to enhance the performance and extend the effective life of felts by minimizing formation of deposits and/or removing such deposits as exemplified above.

The felt conditioners can be applied continuously or intermittently to papermaking felts, optionally while paper is being produced through showers, or other means during the fabric return stage, while the felt is not in contact with the paper web. These treatments can be applied on the inside, or machine side, of the felt through low pressure showers, often just prior to a felt carrier roll such that hydraulic force will help move the chemical into the felt to help prevent and remove contaminants that fill the felt. Such treatments can be applied, through similar showers on the sheet side of the felt after the uhle box and before the nip so that the treatment is present on the surface when contaminants first reach the felt.

The felt conditioner can be applied to the felt in any way such that the quantity on or within the felt is sufficient to produce the desired effect. The felt conditioner can be applied at any time to the felt as it rotates in a belt-like fashion between sheet contact stages and return stages. For example, the felt conditioner can be sprayed, brushed, rolled, or puddled directly on the felt surface. The felt conditioner can be applied by similar means, to the various equipment surfaces that come in contact with the felt, such as the felt carrier rolls; the felt conditioner would then be transferred to the felt surface when contact is made between the felt and the treated equipment surface. A portion of the felt can be immersed within a solution of the felt conditioner, such as by passing it through a vat containing the felt conditioner during the felt return stage, so that the felt conditioner is absorbed on or into the felt as the felt passes through the vat. The felt conditioner can also be added to the paper stock system either before the paper web is made or applied to the web just prior to it contacting the felt. The felt conditioner can enter the felt with the sheet water.

The felt conditioner of the present invention can be used to clean or condition: a) dryer felt(s), used in a paper machine; b) paper machine forming fabric(s); c) forming fabrics and/or press felts used on a pulp dryer (or pulp uptake machine or a machine that produces market pulp instead of paper; d) forming fabric(s) on a cylinder machine or other types of paper machines; e) screens and/or cleaners used in a pulp mill or paper mill.

In any method, the felt conditioner can be applied neat (undiluted) or diluted in a solvent/carrier system. For example the felt conditioner could be applied to the felt undiluted using an atomized mist spray system. The felt conditioner can be applied to the felt using any of the various aqueous low and/or high pressure cleaning or lubrication showers that are commonly used on the machine side and/or sheet side of the felt. The shower can be applied to the felt at a rate of about 0.01 to about 0.15 gallons or more per minute per inch width of felt. The concentration of the solketal within the aqueous shower can be from about 0.1 ppm to about 1000 ppm (or higher) by weight, or from about 1 ppm to about 200 ppm by weight.

The felt conditioner can be applied intermittently or continuously to the felt, for instance, while the paper is being produced. The felt conditioner can be applied either to the machine side of the felt or to the sheet side of the felt or both. The felt conditioner can be applied to the felt while paper is being made, for instance, such that the felt is continuously moving and a portion of the felt is in direct simultaneous contact with a portion of the paper at any time. The felt conditioner can be applied anywhere on the felt in an area where it is not in simultaneous contact with the sheet on the machine side or on the sheet side.

An oxidizer(s), an acid(s), and/or an alkali(s) can be contained in the felt conditioners of the present invention. The amounts can be from about 1 wt % to about 90 wt % by overall weight of the felt conditioner.

The felt conditioner of the present invention can also contain one or more enzymes, one or more formulation aids, one or more stabilizers, and/or one or more preservatives.

Any enzyme that can be applied as a liquid to a press felt on a paper machine, while the paper machine is producing paper, such that the enzyme will act on a substance to assist in the removing and/or to inhibit it from depositing on or in the felt, can be used. The enzymes can be derived from or modified from bacterial or fungal origins. Examples of an enzyme include lipase, amylases, hemicellulases, cellulases, and/or proteases.

At least one diluent and/or preservative can be also present in the felt conditioner. Examples include water, alcohol(s), salt(s), and the like. Examples of diluents and/or preservatives include, but are not limited to, propylene glycol, sorbitol, glycerol, sucrose, maltodextrin, calcium salts, sodium chloride, boric acid, potassium sorbate, methionin and benzisothiazolinone. Defoamers and/or viscosity modifiers can be present in the felt conditioner of the present invention.

Example of additional components that can be present in the felt conditioner include one or more surfactants and/or cationic or anionic dispersants or polymers. Surfactants include, but are not limited to, alcohol ethoxylates, alkylphenol ethoxylates, block copolymers containing ethylene oxide and propylene oxide, alkyl polyglycosides, polyethylene glycol esters of long chain fatty acids, ethoxylated fatty amines, betaines, amphoacetates, fatty alkyl imadazolines, alkyl amidopropyl dimethylamines, dialkyl dimethyl ammonium chloride, alkyl dimethyl benzyl ammonium chloride, alkyl sulfate, alkyl ethosulfate, alkylbenzyl sulfonate, alkyl diphenyloxide disulfonate, alcohol ethosulfates and phosphate esters.

Examples of the cationic or anionic dispersants or polymers include, but are not limited to, naphthalene sulfonate formaldehyde condensate, acrylic acid polymers or copolymers, lignosulfonates, polyvinyl amine, polydiallyl dimethyl ammonium chloride, or polymers obtained by reacting epichlorohydrin with at least one amine selected from dimethylamine, ethylene diamine, dimethylamine proplyamine and polyalkylene polyamine.

Examples of other additional ingredients that can be used besides the solketal are described in U.S. Pat. No. 4,715,931 (Schellhamer), WO 95/29292 (Duffy), U.S. Pat. No. 4,895,622 (Barnett), U.S. Pat. No. 4,861,429 (Barnett), U.S. Pat. No. 5,167,767 (Owiti), CA 2,083,404 (Owiti), U.S. Pat. No. 5,520,781 (Curham), U.S. Pat. No. 6,051,108 (O'Neal), U.S. Pat. No. 5,575,893 (Khan), U.S. Pat. No. 5,863,385 (Siebott), U.S. Pat. No. 5,368,694 (Rohlf), U.S. Pat. No. 4,995, 994 (Aston), and U.S. Pat. No. 6,171,445 (Hendriks), the entire contents of each is herein incorporated by reference.

Examples of nonionic surfactants include, but are not limited to, various condensation products of alkylene oxides, such as ethylene oxide (EO), with a hydrophobic molecule. Examples of hydrophobic molecules include fatty alcohols, fatty acids, fatty acid esters, triglycerides, fatty amines, fatty amides, alkylphenols, polyhydric alcohols and their partial fatty acid esters. Other examples include polyalkylene oxide block copolymers, ethylenediamine tetra block copolymers of polyalkylene oxide, and alkyl polyglycosides. Examples include nonionic surfactants that are fatty alcohol ethoxylates where the alcohol is about $C_{10}$ to $C_{18}$ branched or linear, such as the Surfonic~ L (Huntsman Corporation, Houston, Tex.) or TDA series, the Neodol™ (Shell Chemical Company, Houston, Tex.) series and the Tergitol™ series (Union Carbide Corporation, Danbury Conn.). Other examples of nonionic surfactants include alkylphenol ethoxylates, polyethylene glycol esters of long chain fatty acids, ethoxylated fatty amines, polymers containing ethylene oxide and propylene oxide blocks, and alkyl polyglycosides.

Other examples of surfactants include amphoteric, cationic, and/or anionic surfactants. Examples of amphoteric surfactants include betaines, sultaines, aminopropionates, and carboxylated imidazoline derivatives. Examples of amphoterics include fatty alkyl chains from about $C_{10}$ to $C_{18}$, and can include alkyl betaine, alkyl amidopropyl betaine, sodium alkylamphoacetate, and disodium alkylamphodiacetate. Examples of cationic surfactants include fatty alkyl amines, fatty alkyl imidazolines, amine oxides, amine ethoxylates, and quaternary ammonium compounds having from 1 to 4 fatty alkyl groups on the quaternary nitrogen or dialkyl imidazoline quaternary. Examples of cationic surfactants include fatty alkyl chains from about $C_{10}$ to $C_{18}$ and include fatty alkyl imadazoline, alkyl amidopropyl dimethyl amines, dialkyl dimethyl ammonium chloride, and alkyl dimethyl benzyl ammonium chloride. Examples of anionic surfactants include sulfates, sulfonates, phosphate esters, and carboxylates of the hydrophobic molecules described previously for nonionic surfactants and their condensation products with ethylene oxide. Examples of anionic surfactants include sodium, ammonium or potassium salts of alkyl sulfate, alkyl ethosulfate, alkylbenzyl sulfonate, alkyl diphenyloxide disulfonate, and the acid or salt versions of phosphate esters of alcohol ethoxylates or alkylphenol ethoxylates.

Examples of anionic polymers include, but are not limited to, polymers based on acrylic acid, methacrylic acid, or other unsaturated carbonyl compounds such as fumaric acid, maleic acid or maleic anhydride and their neutralized versions. These compounds can also be copolymerized with such compounds as polyethylene glycol allyl ether, allyloxy hydroxypropane sulfonic acid, alkenes such as isobutylene, and vinyl compounds such as styrene. Such polymers can additionally be sulfonated. Further examples of anionic polymers include polynaphthalene sulfonate formaldehyde condensate and sulfonated lignins. Examples of anionic polymers include lignosulfonates; polynaphthalene sulfonate formaldehyde condensates having molecular weights from about 400 to 4,000, and polyacrylic or methacrylic acid polymers or copolymers having molecular weights from about 1,000 to 100,000.

Examples of cationic polymers include, but are not limited to, water soluble cationic polymers that contain amines (primary, secondary, or tertiary) and/or quaternary ammonium groups. Examples of cationic polymers include those obtained by reaction between an epihalohydrin and one or more amines, polymers derived from ethylenically unsaturated monomers containing an amine or quaternary ammonium group, dicyandiamide-formaldehyde condensates, and post cationized polymers. Post cationized polymers include mannich polymers which are polyacrylamides cationized with dimethyl amine and formaldehyde which can then be quarternized with methyl chloride or dimethyl sulfate. Examples of cationic polymers include ones derived from unsaturated monomers include polyvinyl amine and polydiallyl dimethyl ammonium chloride. Examples of cationic polymers include those obtained by reacting epichlorohydrin (EPI) with at least one amine selected from dimethylamine (DMA), ethylene diamine (EDA), dimethylamine propylamine, and polyalkylene polyamine. Triethanolamine and/or adipic acid may also be included in the reaction. Such polymers can be linear or branched and partially crosslinked and preferably range in molecular weight from about 1,000 to about 1,000,000.

The present invention will be further clarified by the following examples, which are intended to be exemplary of the present invention.

EXAMPLES

Example 1

To evaluate the felt conditioner of the present invention, various tests were run to determine its ability to clean soiled felt samples as well as other properties as further described below.

Specifically, in these examples, a felt conditioner formulation was prepared by using 1 wt % of solketal which was diluted in water.

To prepare the soiled felt samples, soiled felt from a commercial paper mill was obtained and this was cut into squares of 5×5 cm for the water absorption test and the remaining were cut into squares of 12×12 cm for the filtration test. The felt samples were dried at 50° C. for two hours and the samples were then weighed. As indicated above, a 1% (v/v) solution of the felt conditioner product of the present invention was prepared in water. Then, some of the felt squares were immersed in 900 mL of the 1% felt conditioner at 50° C. for two hours while stirring at approximately 50 rpm. For a control sample, additional felt squares were used in 900 mL of just water at 50° C. for two hours while stirring at the same rate. This is considered the "blank." After two hours, the felt conditioner formulation or the water blank was removed and the felt samples were rinsed thoroughly with water and then dried at 105° C. for 30 minutes.

Afterwards, the dried felt samples (which received treatment of the present invention or the control), were placed horizontally with the paper contact side up and then 1 mL of water was placed on each felt sample with a pipette. The amount of time for the water to be absorbed was recorded. This test was repeated five times and the average water absorption in seconds was obtained.

For the present invention, the average water absorption was 5.68 seconds and for the control or blank samples the average water absorption was over one minute. It is noted that as part of the testing here, various commercial felt conditioner solutions were also used and none of the commercially available solutions tested which contained different active ingredients provided a water absorption that was faster than the present invention. Further, during the testing, it was noted that the felt conditioner formulation of the present invention had a noticeably lower odor and further had a much higher flashpoint.

The results of the water absorption clearly show that the soiled felt was adequately cleaned versus the control or blank sample.

Regarding the filtration test, as indicated, additional 12×12 cm felt squares that were soiled and then cleaned and cut into a 7.5 cm diameter circle were then placed in a Dynamic Drainage Jar and filled with 500 mL of water. The felt was located in the jar such that when the valve was open, the water would need to pass through the felt. The amount of time it takes for the water to run out of the jar through the valve was recorded. With the present invention, the amount of time for filtration was 25.78 seconds for the 500 mL of water to exit the jar. For the blank or control sample, the amount of time was over five minutes. Further, as a comparison with commercially available felt conditioner formulations, the present invention was as good if not significantly better with regard to a short filtration time, which again reflects that the felt samples conditioned by the present invention's formulation was very effective in cleaning the used felt.

Finally, other 5×5 cm felt samples were dried for two hours at 50° C. and the amount of weight loss was recorded. These additional felt samples were either treated with the formulation of the present invention or were a control. Essentially, the deposit weight loss test is a way to record the amount of deposits removed by the treatment. With the present invention, the weight loss recorded was 0.65% (which is essentially comparing the weight of the cleaned felts with the weight of original soiled felts prior to treatment).

Additional felt samples obtained from other commercial paper-making plants were further tested in the same manner as above and it is noted that in each instance, the treatment using the felt conditioner of the present invention as described in the above examples provided significantly improved properties with regard to the water absorption test and filtration test.

Example 2

A felt cleaning trial was performed on a press section of an industrial papermaking machine used for dewatering a paper web, which compared the performance of a felt conditioner of the present invention with a commercial product.

The felt conditioner of the present invention ("FC") that was used in the trial had the composition indicated in Table 1:

TABLE 1

| PRODUCT NAME: FC | | |
|---|---|---|
| | Component | wt % in formula |
| (1) | (+/−)-2,2-dimethyl-4-hydroxymethyl-1,3-dioxolane | 22 |
| (2) | Ethoxylated Tridecanol | 7.5 |
| (3) | Dodecyl Alcohol Ethoxylate | 7.5 |
| (4) | Water | 63 |

The components in Table 1 were commercially available. Component 1 is a solketal product. Component 2 is a nonionic surfactant product. Component 3 is a polyoxyethylene lauryl ether. The felt conditioner (FC) was a clear colorless liquid. The felt conditioner (FC) was prediluted in water to a 1% (v/v) solution before use in felt treatments in the trial.

For comparison, test data was obtained for a commercial dispersant product used on the same press section felts, which was BUSPERSE® 2281 ("BSP 2281"), available from Buckman Laboratories International, Inc., Memphis, Tenn.

For the trial, the addition point for the treatment composition (FC or BUSPERSE® 2281) was the felt press spray pipe. Test data was collected for the felt conditioner (FC) over 23 consecutive days of production run time, and for the BSP 2281 over 13 consecutive days of production run time. Other features of the application strategy and procedures are shown in Table 2.

TABLE 2

| Application | Product name | No. of cleaning times/day | Weight/each cleaning | Total Weight/day of cleaning |
|---|---|---|---|---|
| Felt cleaning | BSP 2281 | 10 | 5 kg | 50 kg |
| | FC | 10 | 4 kg | 40 kg |

Vacuum pressure level data was recorded before and after the press section felts for each day of the trial conducted on each of the indicated conditioner compositions. The pressure values were all recorded in the same units, e.g., units of kPa. The average vacuum pressure values for pre-suction, 1st upper suction, 1st lower suction, 2nd upper suction, and 2nd lower suction press felt locations for the trial using FC and the trial using BSP 2281 are shown in Table 3.

TABLE 3

| Product | Pre-suction | 1st upper suction | 1st lower suction | 2nd upper suction | 2nd lower suction |
|---|---|---|---|---|---|
| BSP 2281 | 36 | 39 | 36 | 41 | 45 |
| FC | 34 | 40 | 40 | 42 | 47 |

The results in Table 3 show that use of the felt conditioner of the present invention (FC) is effective to control the existing production output requirements. Further, compared to commercial product tested, the usage of the felt conditioner of the present invention (FC) per ton of papers is reduced by 20%. These results show that the felt conditioner of the present invention can be used to improve the life of the felt.

The present invention includes the following aspects/embodiments/features in any order and/or in any combination:

1. A method for cleaning or conditioning a fabric, belt, felt, or screen utilized in a paper-making or pulp making process, said method comprising treating at least portions of said fabric, belt, felt or screen with a formulation, said formulation comprising solketal and, optionally, at least one surfactant.
2. A method for cleaning or conditioning a paper-making press felt utilized in a paper-making process, said method comprising treating at least portions of said paper-making press felt with a formulation, said formulation comprising solketal and, optionally, at least one surfactant.
3. The method of any preceding or following embodiment/feature/aspect, wherein said formulation comprises at least one surfactant.
4. The method of any preceding or following embodiment/feature/aspect, wherein said formulation comprises at least one non-ionic surfactant.

5. The method of any preceding or following embodiment/feature/aspect, wherein said formulation further comprises at least one anionic surfactant.

6. The method of any preceding or following embodiment/feature/aspect, wherein said formulation further comprises at least one cationic surfactant.

7. The method of any preceding or following embodiment/feature/aspect, wherein said formulation further comprises one or more solvents, wherein said one or more solvents are not solketal.

8. The method of any preceding or following embodiment/feature/aspect, wherein said conditioning inhibits deposition of deposits or filling on or within a felt structure of said paper-making press felt.

9. The method of any preceding or following embodiment/feature/aspect, wherein said treating is continuous.

10. The method of any preceding or following embodiment/feature/aspect, wherein said treating is intermittent.

11. The method of any preceding or following embodiment/feature/aspect, wherein said formulation further comprises one or more additional felt conditioning chemicals, cleaning chemicals, or both.

12. A method of cleaning or conditioning a substrate, said method comprising treating said substrate with a formulation, said formulation comprising solketal.

13. The method of any preceding or following embodiment/feature/aspect, wherein said substrate is a pulp making or paper making machine or a part thereof or surface thereof.

14. The method of any preceding or following embodiment/feature/aspect, wherein said substrate is a screen or cleaner used in a pulp mill or paper mill.

15. The method of any preceding or following embodiment/feature/aspect, wherein said substrate is a dryer felt, paper machine forming fabric, fabric or felt used on a pulp dryer, or forming fabric on a cylinder machine.

16. The method of any preceding or following embodiment/feature/aspect, wherein said paper-making press felt is a continuous felt.

17. The method of any preceding or following embodiment/feature/aspect, wherein the paper-making press felt comprises a rotating continuous conveyor belt and the formulation is applied at least once per revolution of the rotating conveyor belt.

18. The method of any preceding or following embodiment/feature/aspect, wherein the treating comprises spraying the formulation onto the paper-making press felt.

19. The method of any preceding or following embodiment/feature/aspect, wherein the treating comprises soaking the paper-making press felt in the formulation.

20. The method of any preceding or following embodiment/feature/aspect, wherein said formulation further comprises at least one acid, at least one base, or a combination thereof 21. The method of any preceding or following embodiment/feature/aspect, wherein said formulation further comprises at least one surfactant, water or other diluent, or both.

22. The method of any preceding or following embodiment/feature/aspect, wherein said formulation comprises from about 10 wt % to about 95 wt % of said solketal.

23. The method of any preceding or following embodiment/feature/aspect, wherein said at least one surfactant is present in an amount of from about 1 wt % to about 90 wt % based on the weight of the formulation.

The present invention can include any combination of these various features or embodiments above and/or below as set forth in sentences and/or paragraphs. Any combination of disclosed features herein is considered part of the present invention and no limitation is intended with respect to combinable features.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A method for cleaning or conditioning a fabric, belt, felt, or screen utilized in a paper-making or pulp making process, said method comprising treating at least portions of said fabric, belt, felt or screen with a formulation, said formulation comprising solketal and, optionally, at least one surfactant, wherein said solketal is present in said formulation at a concentration of from 1 ppm to 1,000 ppm, and wherein the formulation comprising solketal provides the ability to clean or condition by using an amount less by weight than a comparative formulation containing an aromatic solvent at the same concentration, to achieve the same degree of cleaning or conditioning.

2. The method of claim 1, wherein said formulation comprises at least one surfactant.

3. The method of claim 1, wherein said formulation comprises at least one non-ionic surfactant.

4. The method of claim 1, wherein said formulation further comprises at least one anionic surfactant.

5. The method of claim 1, wherein said formulation further comprises at least one cationic surfactant.

6. The method of claim 1, wherein said formulation further comprises one or more solvents, wherein said one or more solvents are not solketal.

7. The method of claim 1, wherein said conditioning inhibits deposition of deposits or filling on or within a felt structure of said paper-making press felt.

8. The method of claim 1, wherein said treating is continuous.

9. The method of claim 1, wherein said treating is intermittent.

10. The method of claim 1, wherein said formulation further comprises one or more additional felt conditioning chemicals, cleaning chemicals, or both.

11. The method of claim 1, wherein said paper-making press felt is a continuous felt.

12. The method of claim 1, wherein the paper-making press felt comprises a rotating continuous conveyor belt and the formulation is applied at least once per revolution of the rotating conveyor belt.

13. The method of claim 1, wherein the treating comprises spraying the formulation onto the paper-making press felt.

14. The method of claim 1, wherein the treating comprises soaking the paper-making press felt in the formulation.

15. The method of claim 1, wherein said formulation further comprises at least one acid, at least one base, or a combination thereof.

16. The method of claim 1, wherein said formulation further comprises at least one surfactant, water or other diluent, or both.

17. The method of claim 1, wherein said formulation comprises from about 0.5 wt % to about 99.5 wt % of said solketal.

18. The method of claim 16, wherein said at least one surfactant is present in an amount of from about 1 wt % to about 90 wt % based on the weight of the formulation.

19. A method for cleaning or conditioning a paper-making press felt utilized in a paper-making process, said method comprising treating at least portions of said paper-making press felt with a formulation, said formulation comprising solketal and, optionally, at least one surfactant, wherein said solketal is present in said formulation at a concentration of from 1 ppm to 1,000 ppm, and wherein the formulation comprising solketal provides the ability to clean or condition by using an amount less by weight than a comparative formulation containing an aromatic solvent at the same concentration, to achieve the same degree of cleaning or conditioning.

20. The method of claim 19, further comprising applying the formulation intermittently or continuously to the paper-making press felt while paper is being produced by the paper-making process.

21. The method of claim 20, wherein the felt is continuously moving and a portion of the felt is in direct simultaneous contact with a portion of the paper during the paper-making process.

22. A method of cleaning or conditioning a substrate, said method comprising treating said substrate with a formulation, said formulation comprising solketal, wherein said substrate is a dryer felt, paper machine forming fabric, fabric or felt used on a pulp dryer, or forming fabric on a cylinder machine, wherein said solketal is present in said formulation at a concentration of from 1 ppm to 1,000 ppm, and wherein the formulation comprising solketal provides the ability to clean or condition by using an amount less by weight than a comparative formulation containing an aromatic solvent at the same concentration, to achieve the same degree of cleaning or conditioning.

23. The method of claim 11, wherein said substrate is a pulp making or paper making machine or a part thereof or surface thereof.

24. The method of claim 11, wherein said substrate is a screen or cleaner used in a pulp mill or paper mill.

* * * * *